US008171933B2

(12) United States Patent
Xue et al.

(10) Patent No.: US 8,171,933 B2
(45) Date of Patent: May 8, 2012

(54) RESPIRATOR HAVING PRELOADED NOSE CLIP

(75) Inventors: Thomas J. Xue, St. Paul, MN (US); Yonas Gebrewold, Roseville, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 1871 days.

(21) Appl. No.: 11/211,962

(22) Filed: Aug. 25, 2005

(65) Prior Publication Data

US 2007/0044803 A1 Mar. 1, 2007

(51) Int. Cl.
*A62B 17/00* (2006.01)
*A62B 18/02* (2006.01)

(52) U.S. Cl. ..... 128/206.21; 128/206.12; 128/206.24; 128/206.28; 128/207.11; 128/207.17

(58) Field of Classification Search ..... 128/206.21, 128/206.23, 206.24, 206.28, 207.11
See application file for complete search history.

(56) References Cited

U.S. PATENT DOCUMENTS

| | | | | |
|---|---|---|---|---|
| 3,603,315 | A | 9/1971 | Becker, III | |
| 3,779,244 | A | 12/1973 | Weeks, Jr. et al. | |
| 3,786,126 | A | 1/1974 | Reimschussel et al. | |
| RE28,102 | E | 8/1974 | Mayhew | |
| 4,167,185 | A | 9/1979 | Lewis | |
| 4,300,549 | A | 11/1981 | Parker | |
| 4,419,993 | A | 12/1983 | Petersen | |
| 4,419,994 | A | 12/1983 | Hilton | |
| 4,536,440 | A | 8/1985 | Berg | |
| 4,600,002 | A | 7/1986 | Maryyanek et al. | |
| 4,616,647 | A | 10/1986 | McCreadie | |
| 4,796,621 | A * | 1/1989 | Barle et al. | 128/206.23 |
| 4,802,473 | A | 2/1989 | Hubbard et al. | |
| 4,807,619 | A | 2/1989 | Dyrud et al. | |
| 4,827,924 | A | 5/1989 | Japuntich | |
| 4,873,972 | A | 10/1989 | Magidson et al. | |
| 4,951,664 | A | 8/1990 | Niemeyer | |
| 5,103,813 | A * | 4/1992 | Hart et al. | 128/201.18 |
| 5,307,796 | A | 5/1994 | Kronzer et al. | |
| 5,322,061 | A | 6/1994 | Brunson | |
| 5,374,458 | A * | 12/1994 | Burgio | 428/36.1 |
| 5,558,089 | A | 9/1996 | Castiglione | |

(Continued)

FOREIGN PATENT DOCUMENTS

GB 2103491 A 2/1983

(Continued)

OTHER PUBLICATIONS

JP 2005035148 A; Feb. 2005. Machine translation provided by JPO, Matsuzaka et al., entire document.*

(Continued)

*Primary Examiner* — Clinton T Ostrup
(74) *Attorney, Agent, or Firm* — Karl G. Hanson

(57) ABSTRACT

A respirator that includes a mask body and a nose clip. The mask body is adapted to fit over the nose and mouth of a person, and the nose clip is placed on the mask body to extend over the bridge of the wearer's nose when the mask is worn. The nose clip has a predefined shape that comprises first and second wings. These wings exert a force resiliently inward on each side of the wearer's nose when the mask is worn. The invention eliminates the need for the wearer to individually shape the nose clip to the wearer's nose.

20 Claims, 5 Drawing Sheets

U.S. PATENT DOCUMENTS

| | | | | |
|---|---|---|---|---|
| 5,617,849 | A * | 4/1997 | Springett et al. | 128/206.24 |
| 5,673,690 | A | 10/1997 | Tayebi et al. | |
| 5,724,677 | A * | 3/1998 | Bryant et al. | 2/206 |
| 5,843,470 | A * | 12/1998 | Reeve et al. | 424/426 |
| D412,573 | S | 8/1999 | Castiglione | |
| 6,035,852 | A | 3/2000 | Hoftman | |
| 6,116,236 | A | 9/2000 | Wyss | |
| 6,119,691 | A | 9/2000 | Angadjivand et al. | |
| 6,123,077 | A | 9/2000 | Bostock et al. | |
| D443,927 | S | 6/2001 | Chen | |
| D448,472 | S | 9/2001 | Chen | |
| 6,332,465 | B1 * | 12/2001 | Xue et al. | 128/205.25 |
| 6,336,456 | B1 * | 1/2002 | Ruben | 128/206.19 |
| D458,364 | S | 6/2002 | Curran et al. | |
| D459,471 | S | 6/2002 | Curran et al. | |
| RE37,974 | E | 2/2003 | Bowers | |
| 6,715,489 | B2 | 4/2004 | Bostock | |
| 6,722,366 | B2 | 4/2004 | Bostock | |
| 6,827,764 | B2 | 12/2004 | Springett et al. | |
| 6,854,463 | B2 | 2/2005 | Japuntich et al. | |
| 2001/0015205 | A1 * | 8/2001 | Bostock et al. | 128/206.19 |
| 2002/0026943 | A1 * | 3/2002 | Castiglione | 128/207.11 |
| 2004/0118405 | A1 | 6/2004 | Amante et al. | |

FOREIGN PATENT DOCUMENTS

| | | | |
|---|---|---|---|
| JP | 2002-325855 | | 11/2002 |
| JP | 2002325855 | A * | 11/2002 |
| JP | 2005035148 | A * | 2/2005 |
| JP | 2005-152030 | | 6/2005 |

OTHER PUBLICATIONS

JP 2002325855 A; Nov. 2002. Machine translation provided by JPO, Yunoki, Nobuo, entire document.*

Matsuzaka et al., English Translation of JP2002035148A, Feb. 10, 2005, Shape Retaining Material, Nose Clip for Face Mask, and Face Mask, Whole Document.*

Nobuo (JP 2002-325855A), Machine translation provided by the JPO, Translated Mar. 27, 2011, p. 1-11.*

* cited by examiner

RESPIRATOR HAVING PRELOADED NOSE CLIP

The present invention pertains to a respiratory mask that has a nose clip that is located on a mask body such that it exerts a compression force on opposing sides of the wearer's nose when the mask is worn. The force occurs as a result of the predefined shape that is provided to the nose clip.

BACKGROUND

Respirators (sometimes referred to as "filtering face masks" or "filtering face pieces") are worn over the breathing passages of a person for two common purposes: (1) to prevent impurities or contaminants from entering the wearer's breathing track; and (2) to protect other persons or things from being exposed to pathogens and other contaminants exhaled by the wearer. In the first situation, the respirator is worn in an environment where the air contains particles that are harmful to the wearer, for example, in an auto body shop. In the second situation, the respirator is worn in an environment where there is risk of contamination to others persons or things, for example, in an operating room or clean room.

To achieve these purposes, the respirator must be able to maintain a snug fit when placed on the wearer's face. Known respirators can, for the most part, match the contour of a person's face over the cheeks and chin. In the nose region, however, there is a radical change in contour, which makes it difficult to achieve a snug fit over that portion of the wearer's face. Failure to obtain a snug fit allows air to enter or exit the respirator interior without passing through the filter media. In this situation, contaminants may enter the wearer's breathing track, and other persons or things may be exposed to contaminants exhaled by the wearer. In addition, a wearer's eyeglasses can become fogged when the exhalate escapes from the respirator interior over the nose region of the mask. Fogged eyewear, of course, makes visibility more troublesome to the wearer and creates unsafe conditions for the user and others.

Nose clips are commonly used on respirators to achieve a snug fit over the wearer's nose. Conventional nose clips are in the form of malleable, linear, strips of aluminum—see, for example, U.S. Pat. Nos. 5,307,796, 4,600,002, 3,603,315; see also U.K. Patent Application GB 2,103,491 A. A more recent product uses an "M" shaped band of malleable metal to improve fit in the nose area—see U.S. Pat. No. 5,558,089 and Des. U.S. Pat. No. 412,573 to Castiglione. Although metal nose clips provide a snug fit over the wearer's nose, they must be individually adapted to the shape of each user's nose. To achieve a proper fit, the user often needs instructions and/or training to ensure that a proper fit is achieved. If during use, the nose clip changes from its adapted shape, the user needs to recognize this and readapt the shape of the nose clip so that there is no leakage (also known as "blow by") around the wearer's nose during use.

SUMMARY OF THE INVENTION

The present invention provides a new respirator that comprises (a) a mask body that comprises a layer of filter media; and (b) a nose clip that is disposed on the mask body to extend over the bridge of the wearer's nose when the mask is worn. The nose clip has a resilient predefined shape that comprises first and second wing portions and exerts a force on each side of the wearer's nose when the mask is worn. The force is exerted at least inward towards the wearer's nose at the first and second wing portions.

The invention also provides a new method of making a respirator, which method comprises: (a) providing a mask body; (b) placing a nose clip on the mask body such that it extends over the bridge of the wearer's nose when the mask is worn; and (c) providing the nose clip with a predefined shape that has a semi-rigid, resilient character. The steps may be performed in any order or contemporaneously. For example, step (b) may occur before step (c), or step (c) may occur before step (b), or the steps all may occur at essentially the same time.

Unlike known respirators, the inventive respirator does not require that its nose clip be individually shaped by each user to achieve a proper fit. Because the nose clip has a predefined shape that enables a force to be exerted on each side of the wearer's nose when the mask is worn, the user does not have to adapt the shape of the nose clip to achieve a good seal. Further, the predefined shape, and the force that is exerted inward on each side of the nose by the first and second wing portions, precludes the nose clip from changing from an intended shape, and therefore the clip does not require any need for readapting its shape to prevent leakage. The present invention thus requires less effort and maintenance by the wearer to achieve a good fit. Another benefit of the invention is that the nose clip can be readily made from known plastic materials, which can be easily incinerated with the mask body when the respirator has met the end of its service life.

These and other advantages of the invention are more fully shown and described in the drawings and detailed description of this invention, where like reference numerals are used to generally represent similar parts. It is to be understood, however, that the drawings and description are for illustration purposes only and should not be read in a manner that would unduly limit the scope of this invention.

Glossary

The terms set forth below will have the meanings as defined:

"aerosol" means a gas that contains suspended particles in solid and/or liquid form;

"clean air" means a volume of atmospheric ambient air that has been filtered to remove contaminants;

"comprises (or comprising)" means its definition as is standard in patent terminology, being an open-ended term that is generally synonymous with "includes", "having", or "containing". Although "comprises", "includes", "having", and "containing" are commonly-used, open-ended terms, this invention also may be described using narrower terms such as "consists essentially of", which is semi open-ended term in that it excludes only those things or elements that would have a deleterious effect on the performance of the nose clip in serving its intended function;

"contaminants" means particles and/or other substances that generally may not be considered to be particles (e.g., organic vapors, et cetera) but which may be suspended in air, including air in an exhale flow stream;

"effective radius" means the distance from a defined center to a circular line that circumscribes a defined shape;

"exhalation valve" means a valve that has been designed for use on a respirator to open unidirectionally in response to pressure from exhaled air;

"exhaled air" is air that is exhaled by a respirator wearer;

"exterior gas space" means the ambient atmospheric gas space into which exhaled gas enters after passing through and beyond the mask body and/or exhalation valve;

"filter media" means an air-permeable structure that is capable of removing contaminants from air that passes through it;

"harness" means a structure or combination of parts that assists in supporting the mask body on a wearer's face;

"interior gas space" means the space between a mask body and a person's face;

"mask body" means a structure that fits over the nose and mouth of a person and that helps define an interior gas space separated from an exterior gas space;

"midsection" is the central part of the nose clip that extends over the bridge or top of a wearer's nose and down at least a portion of each side;

"nose clip" means a mechanical device (other than a nose foam), which device is adapted for use on a filtering face mask to improve the seal at least around a wearer's nose;

"nose foam" means a compressible porous material that is adapted for placement on the interior of a mask body to improve the fit and/or comfort over the nose;

"particles" means any liquid and/or solid substance that is capable of being suspended in air, for example, dusts, mists, fumes, pathogens, bacteria, viruses, mucous, saliva, blood, etc.;

"polymer" means a material that contains repeating chemical units, regularly or irregularly arranged;

"polymeric and plastic" mean that the material mainly contains one or more polymers and may contain other ingredients as well;

"porous structure" means a mixture of a volume of solid material and a volume of voids, which mixture defines a three-dimensional system of interstitial, tortuous channels through which a gas can pass;

"portion" means part of a larger thing;

"predefined" and "predefined shape" means the intended shape provided by the manufacturer when not subject to an external force;

"preform" means a blank of nose clip material of desired size before it has taken on its predefined shape;

"resilient" means being capable of bending when a force is applied and then recovering its original shape when the force is released; while a resilient material bends in response to an applied force, it also pushes back against the applied force in attempting to return to its original position (in using this definition, the amount of "force" that is referred to is an amount consistent with normal respirator use—that is, the amount of force required to effectively seal the respirator to the nose area of a wearer during normal use (such as from regular manual pressure or from respirator harness straps when donning the mask) and does not include excessive forces inconsistent with such use);

"respirator" means a mask that covers at least the nose and mouth of a wearer and that is capable of supplying clean air to a wearer;

"semi-rigid" means that the nose clip is sufficiently rigid to maintain its shape against gravity, but yet is still capable of bending in response to forces that would typically be encountered when the nose clip is used on a facemask;

"snug fit" or "fit snugly" means that an essentially air-tight fit is provided between the mask body and the wearer's face;

"wing" is an element of the nose clip that extends away from the midsection.

DETAILED DESCRIPTION OF THE PREFERRED EMBODIMENTS

In describing preferred embodiments of the invention, specific terminology is used for the sake of clarity. The invention, however, is not intended to be limited to the specific terms so selected, and it is to be understood that each term so selected includes all technical equivalents that operate similarly.

Figure 1:
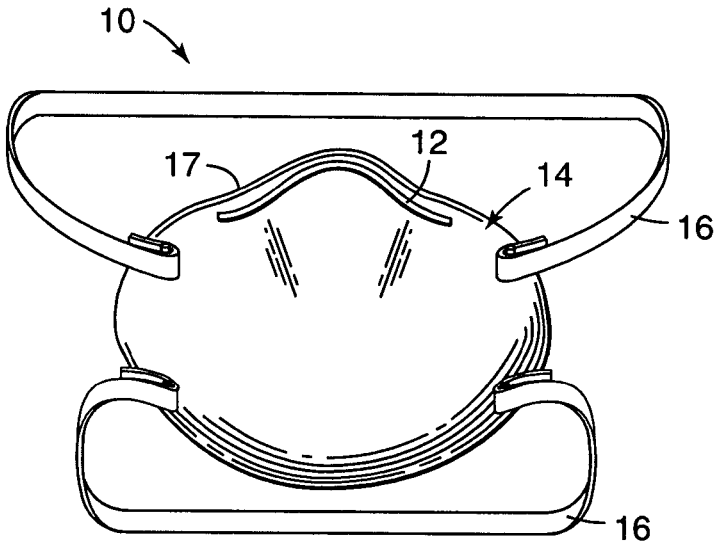
Fig. 1 Prior Art
FIG. 1 is a front view of a prior art respiratory mask 10.

FIG. 1 illustrates a front view of a prior art respiratory mask 10 that has a nose clip 12 disposed on a mask body 14. Before being deformed, the nose clip 12 is typically predefined to have a shape that is as wide (or wider than) essentially any anticipated wearer's nose. The prior art nose clip 12 is typically formed from a malleable metal such as aluminum, which can be conformed by mere finger pressure. The metal that is used is commonly referred to as being "dead soft" because it retains its conformed position until it is readjusted or altered by the wearer. Known respiratory masks also include a harness such as straps 16 that are sized to pass behind the wearer's head to assist in providing a snug fit to the wearer's face. The straps 16 may be adjustable in length, and they can have an elastic character to pull the perimeter 17 of the mask body towards the wearer's face when the respirator 10 is worn.

Figure 2:
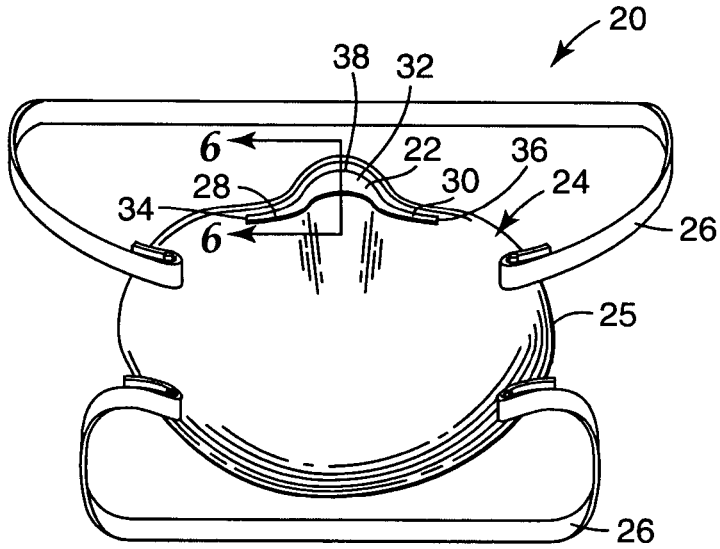
FIG. 2 is a front view of a respirator 20 in accordance with the present invention.

FIG. 2 shows an inventive respiratory mask 20 that has a nose clip 22 of predefined shape. When the mask 20 is worn, the nose clip 22 is capable of exerting a slight compression force on each side of the wearer's nose to insure that the filtering face mask 20 makes a snug fit in this region of the wearer's face. The new mask 20, onto which the nose clip 22 is disposed, takes on a different shape in the nose area when compared to the prior art mask body 14 shown in FIG. 1. The prior art mask 10 does not use a nose clip that has a predefined shape and accordingly does not include a more radical concave downward contour as the mask 20 shown in FIG. 2. Unlike the prior art mask shown in FIG. 1, the inventive mask has a nose clip that is predefined to have a shape that is smaller than essentially any anticipated wearer's nose. In comparing the known respirator 10 shown in FIG. 1 with inventive respirator 20 of FIG. 2, the perimeter 25 of the inventive mask 20 follows a more noticeable or drastically curved path over the nose region when compared to the perimeter 17 of mask 10 in the same area. The tighter curve is the result of the mask body 24 taking on the predefined shape of the nose clip 22 in the nose region of the mask. That is to say, the predefined shape of the nose clip 22, coupled with its semi-rigid, resilient character, can dictate or define the shape of the mask body 24 in the nose region. The tighter, predefined curvature causes the nose clip 22 to generally "pinch" the cup-shaped mask body 24 in the nose region. This causes opposing inward surfaces of the mask body in the nose region to move closer to each other. When a wearer dons the mask body 24, the harness 26 is placed behind the wearer's head to pull the perimeter 25 of mask body 24 against a wearer's face. A result of this pulling force is that the first and second wing portions 28 and 30 generally move away from each other while exerting a slight compression force on opposing sides of the wearer's nose. In the inventive respiratory mask, the predefined nose clip shape causes the mask body to be narrower over the bridge of the wearer's nose. In general, the nose clip can be fashioned such that the mask body is narrower than the width of essentially any anticipated user's nose. Alternatively, the nose clip could be fashioned to have various sizes, for example, small (S), medium (M), or large (L), to accommodate the widths of various nose bridges. The predefined shape of the nose clip 22 thus causes a force on each side of the wearer's nose to provide a snug fit in that area of the wearer's face. Because the present invention exerts a force on each side of the wearer's nose when the mask is worn, there is no need to tailor the nose clip to the shape of the user's nose; nor would there be a need to reform the nose clip to an intended shape.

The respirator body 24 may be of a curved, hemispherical, cup-shape such as shown in FIG. 2—see also U.S. Pat. No. 4,536,440 to Berg and U.S. Pat. No. 4,807,619 to Dyrud et al. The respirator body also may take on other shapes as so desired. For example, the mask body can be a cup-shaped mask having a construction as shown in U.S. Pat. No. 4,827,924 to Japuntich. The mask body also may be a flat-folded product such as disclosed in U.S. Pat. Nos. 6,722,366 and 6,715,489 to Bostock, D459,471 and D458,364 to Curran et al., and D448,472 and D443,927 to Chen. See also U.S. Pat. Nos. 4,419,993, 4,419,994, 4,300,549, 4,802,473, and Re. 28,102. The mask body may include one or more layers of filter media. Commonly, a nonwoven web of electrically-charged microfibers—i.e., fibers having an effective diameter of about 25 micrometers (μm) or less (typically about 1 to 15 μm)—are used as a layer of filter media. The filter media may be charged according to U.S. Pat. No. 6,119,691 to Angadjivand et al. The respirator also can have an exhalation valve located thereon, such as the unidirectional fluid valve disclosed in U.S. Pat. No. 6,854,463 to Japuntich et al. or in U.S. Pat. RE37,974 to Bowers. Essentially any presently known (or later developed) mask body that is air permeable and that includes a layer of filter media could be used in connection with this invention.

The harness straps 26 can be made of an elastic material that causes the mask body 24 to exert a slight pressure on the wearer's face. A number of different materials may be suitable for use as straps 26. For example, the straps 26 may be formed from a thermoplastic elastomer that is ultrasonically welded to the respirator body. In addition, braided elastic bands, rubber cords, or strands (e.g. polyisoprene rubber), and non-elastic adjustable straps may also be used to create a mask harness—see, for example, U.S. Pat. No. 6,705,317 to Castiglione and U.S. Pat. No. 6,332,465 to Xue et al. In addition, ear-loop straps could be used—see U.S. Pat. No. 6,095,143 to Dyrud et al. Essentially any strap system (presently known or later-developed) that is fashioned for use in supporting a respiratory face piece on a wearer's head could be used as a harness in connection with the present invention. The harness also could include a head cradle in conjunction with one or more straps for supporting the mask.

Figure 3:
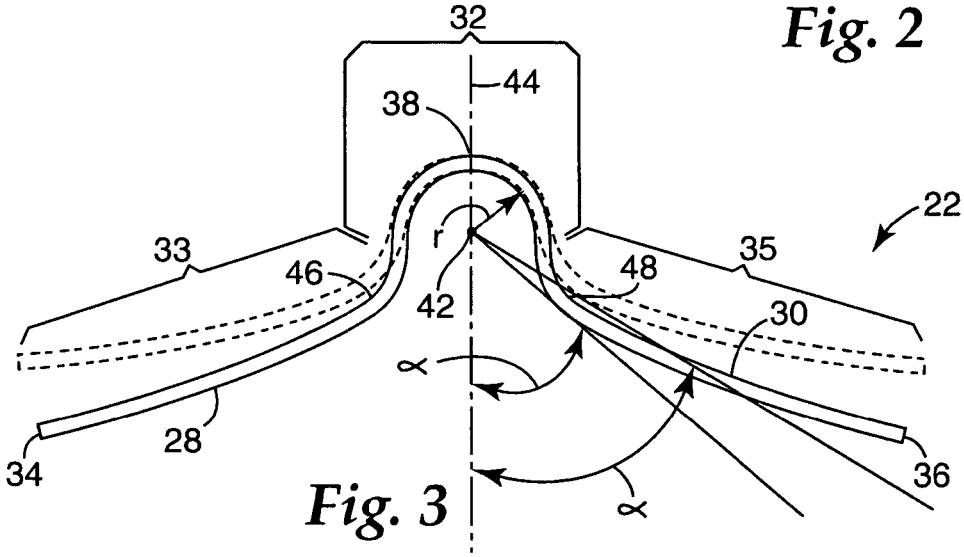
FIG. 3 is a side view of a nose clip 22 that has a predefined shape in accordance with the present invention, the Figure also illustrating a deflection of the nose clip 22 in broken lines.

As shown in FIGS. 2 and 3, the nose clip 22 has a curved convex midsection 32 located centrally between opposing ends 34 and 36. The convex curvature of the midsection 32 is best noticed when viewing the nose clip 22 from a side or edge elevation as shown in FIG. 3. The side elevational curvature of the nose clip 22 also presents two concave sections, 33 and 35. This combination of predefined, symmetrically-disposed, concave sections on opposing sides of a central convex section assists in allowing nose clip 22 to provide a snug fit between the inventive mask and the wearer's nose. The central convex section 32 conforms the mask over the bridge of the wearer's nose, and the concave sections 33 and 35 conform the mask to the wearer's face on the sides of the wearer's nose and, if long enough, at the junctions between the sides of the nose and the cheeks, and if still longer in length, on the cheek bone beneath the eye sockets. As indicated above, the nose clip can be semi-rigid while also being resilient. Thus, the nose clip seeks to maintain its original shape: it resists deformation and returns to original arrangement when any forces that pushed it into an expanded configuration are removed. Because of its resilient nature, the nose clip can be expanded from its original length (see, for example, FIG. 11) by at least 10%, preferably 20%, and more preferably 30% to 40% or 50% or more and still return to its original shape.

Figure 3A:
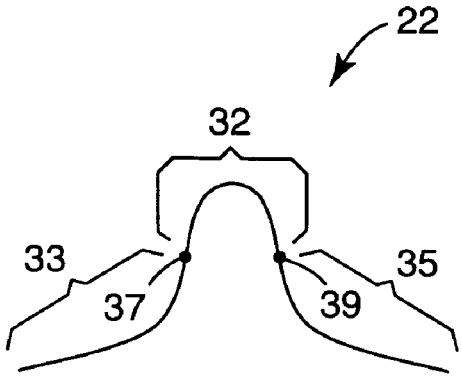
FIGS. 3*a*-3*d* are side views of nose clips that have convex and concave sections 32 and 33, 35, respectively, that are separated by points 37, 39 or straight line sections 40, 41.
Figure 3B:
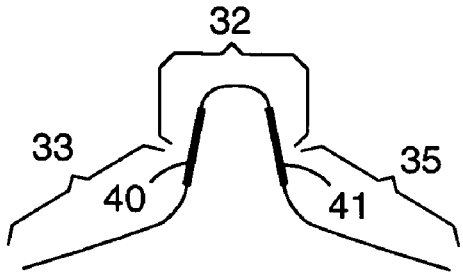
Figure 3C:
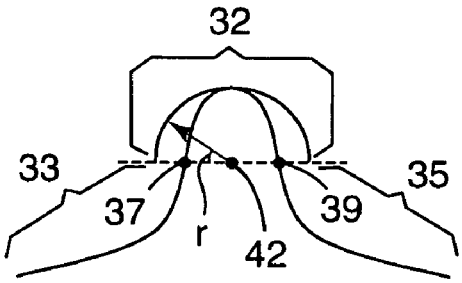
Figure 3D:
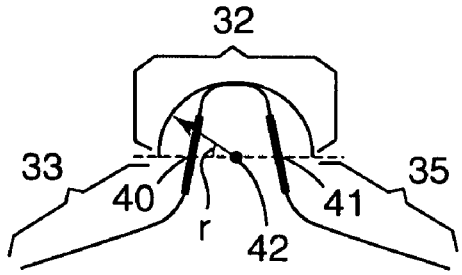

The convex central section 32 of the nose clip can be separated from the two concave sections 33 and 35 by either single points or by straight line segments. As shown particularly in FIG. 3*a*, the curvature of the nose clip 22 can be continuous such that the concave sections 33, 35 are separated from the convex section 32 by points 37 and 39. Alternatively, straight line segments 40 and 41 may be located therebetween as shown in FIG. 3*b*. FIGS. 3*c* and 3*d* show that the effective radius of curvature, r, can be defined as the radius of a semicircle that circumscribes the central convex portion 32 of the nose clip. The radius r extends from the defined center 42. For nose clips that have the central convex portion 32 separated from the concave sections 33 and 35 by points of inflection 37 and 39, point 42 is defined as the midpoint of the line segment joining points of inflection 37 and 39, as shown in FIG. 3*c*. For nose clips that have the central convex portion 32 separated from the concave sections 33 and 35 by straight sections 40 and 41, the point 42 is defined as the midpoint of a line segment joining the midpoints of straight sections 40 and 41, as shown in FIG. 3*d*. Generally, the inventive mask 20 is provided with a nose clip 22 that has an effective radius r over the bridge of the nose of about 0.3 to 1.2 centimeters (cm), more preferably about 0.5 to 0.9 cm.

Referring again to FIG. 3, the nose clip 22 generally takes a 180° symmetrical turn in the convex midsection 32 about the midpoint 38. When viewed from the side, the nose clip generally makes three noticeable turns: the first turn begins in the first concave section 33 and generally ends where section 33 meets the midsection 32, the second turn occurs mainly on opposing sides of midpoint 38 in the midsection 32, and the third turn occurs where the midsection 32 meets the second concave portion 35. The first and third curves are generally less than 90° turns, typically are about 30 to 80° turns, more typically are about 45° to 75° turns, when viewed from the side as shown in FIG. 3. In use, the nose clip 22 deflects from a first position noted in solid lines in FIG. 3 to a second position shown in broken lines. When this deflection occurs, the angle α increases in size as shown in FIG. 3. In its non-deflected position, angle α is generally about 15° to 75°, preferably about 30° to 60°. In deflected condition, angle α generally is about 15° to 30° greater than its nondeflected condition. As shown, angle α is defined as the angle between the center line 44 and a tangent to the first or third curve 46 and 48, respectively. The lines intersect at the defined center point 42. When the first and second wings 28 and 30 are deflected as shown in FIG. 3, they exert a reaction force in a direction that allows the wings to return to their predefined position as noted in the solid lines. The midsection 32 also may contribute to the force that is exerted inwardly toward the wearer's nose. The first and second wing portions 28 and 30 may be formed "integrally" with the midsection 32. As the term "integral" is used in this document, it means being formed at the same time as a single part. In this sense, the whole nose clip may be formed as a single integral whole made from a molded polymeric material.

Figure 4:
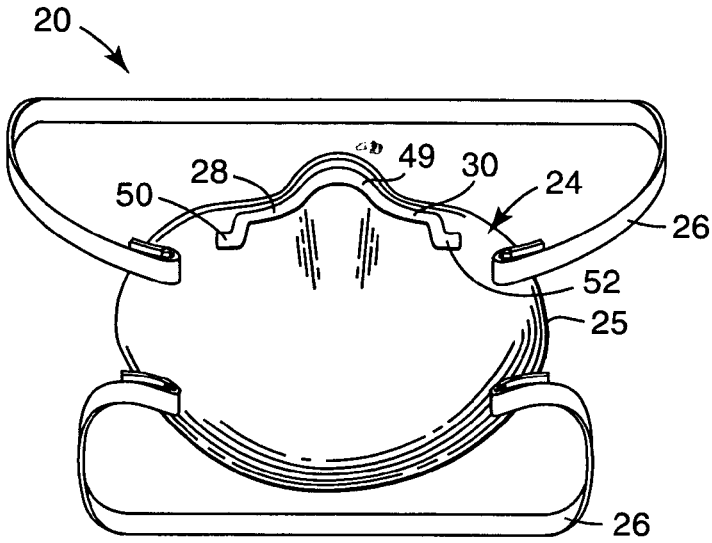
FIG. 4 is a front view of a second embodiment of a respirator 20 in accordance with the present invention.

FIG. 4 shows another embodiment of a nose clip 49. In this embodiment, the first and second wings 28 and 30 have first and second feet 50 and 52 extending therefrom. The feet 50 and 52 allow the nose clip 49 to be extended out further below the wearer's eyes and towards the wearer's cheeks when the mask is worn. This feature can provide further protection and improved fit on the wearer's cheeks beneath each eye. Unlike the embodiment illustrated in FIG. 2, the nose clip 49 has a generally constant width.

Figure 5:
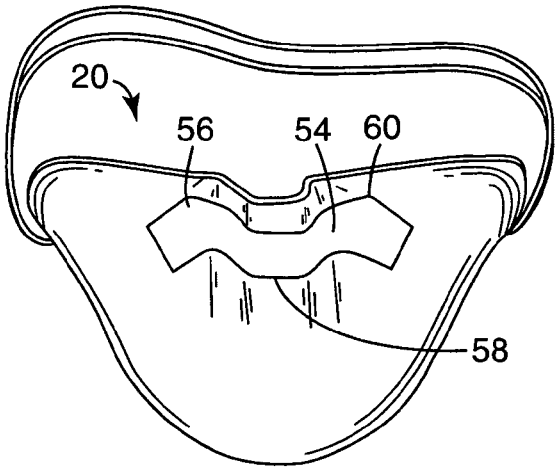
FIG. 5 is a top view of a third embodiment of a respirator 20 in accordance with the present invention.

FIG. 5 illustrates a third embodiment of a nose clip 54. As shown, this nose clip is wider and has a general m-shape to provide first, second, and third inflections 56, 58, and 60 when viewed from the top. A nose clip that has this shape can be beneficial to fit as disclosed in U.S. Pat. No. 5,558,089 to Castiglione.

Figure 6:
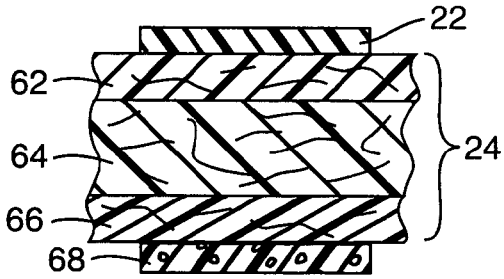
FIG. 6 is a cross-sectional view taken along lines 6-6 of FIG. 2.

FIG. 6 illustrates a cross-section of a mask body 24 having a nose clip 22 located thereon. The mask body 24 is shown to comprise three layers. The first layer 62 may be an outer cover web that protects a second layer(s) of filter media 64. The filter media can be one or more layers of electrically charged fibers such as microfibers—see U.S. Pat. Nos. 6,824,718 and 6,454,986 to Eitzman et al., and U.S. Pat. Nos. 6,783,574, 6,375,886, and 6,119,691 to Angadjivand et al. The third layer 66 can be an inner shaping layer that provides structural shape and integrity to the multi-layered structure that comprises the mask body—see U.S. Pat. No. 5,307,796 to Kronzer et al. The shaping layer, however, can be located on the inside and/or outside of the filtration layer and can be made, for example, from a non-woven web of thermally-bondable fibers molded into a cup-shaped configuration. An inner cover web also could be used to provide the mask with a soft comfortable fit to the wearer's face—see U.S. Pat. No. 6,041,782 to Angadjivand et al. In the nose region, a nose foam 68 also can be provided to improve comfort and fit in this region of the wearer's face.

The nose clip is preferably formed from a thin strip of material that preferably is polymeric, particularly a polymeric material that is a semi-rigid, resilient, solid article at temperatures of about −30° C. to 35° C., preferably −50° C. to 50° C. If a thermoplastic polymeric material is used, the polymer preferably has a glass transition temperature, $T_g$, of at least 35° C., preferably at least 50° C. The $T_g$ preferably is substantially greater than the temperature of use of the working environment of the respiratory mask and has a softening temperature of 90° C. to 250° C. Alternatively, a thermosetting polymer may be used, as long as it can form a pre-shaped nose clip after curing and remain resilient, which polymer has a thermoforming temperature of about 90° C. to about 250° C. Examples of polymers that may be used to form a nose clip include polyethylene terephthalate, polycarbonate, polypropylene, polystyrene, polyetheretherketone (PEEK), polyamide (such as polyamide 6 and polyamide 66), and appropriate copolymers, blends, and combinations thereof. In addition to one or more polymers, a polymeric nose clip may contain other components such as pigments, dyes, and thermal and light stabilizers. Color coatings also can be applied to the nose clip, particularly on its outer visible surface. As indicated, the nose clip preferably has a pre-defined shape that is resilient or semi-rigid. While a rubber band-type material tends to be too flaccid, and a conventional metal nose clip too malleable, the inventive nose clip can be deformed during normal use but does so with resistance to the applied deformation force. Preferably, when a load of 1.5 Newtons (N) or less, more preferably 1 N or less, and still more preferably 0.1 N to 0.6 N, is applied to the nose clip, a 30% deformation or strain results when tested according to the Mechanical Testing Procedure described below. These load values are generally less than that what is needed to deform a conventional malleable aluminum nose clip into an intended shape for wearing. The inventive nose clip may thus have greater flexibility to meet the self-fitting characteristic of the inventive respirator. The nose clip is preferably comprised of a material and that has an elastic modulus (Young's modulus) of 0.5 to 25 Giga Pascals (GPa), more preferably 1 to 15 GPa. In lieu of a polymeric material, the nose clip also could be made from a resilient, semi-rigid metal.

The nose clip can be a single sheet of material or may be a laminate of a plurality of the same or different materials. The nose clip may have smooth surfaces or may have one or two patterned surfaces (that is, the exposed surface or the surface facing the mask body). Patterning can be obtained during a molding step, or it may be present on sheeting before forming the nose clip. On its outer surface, the nose clip preferably has a flat non-reflective surface so that light does not substantially reflect into the wearer's field of vision. Indicia such as the model number or the manufacturer's trademark may be printed on the nose clip. Dyes and pigments may be added to the nose clip to give it a desired color, and stabilizers (for example, stabilizers to ultraviolet light) can be added to the nose clip to improve its service life.

As indicated above, the nose clip has a predefined curve in the region that would extend over the bridge of a wearer's nose when the mask is worn. The nose clip may have a width (width is the dimension that is substantially in the same direction as the length of a wearer's nose, while length of a nose clip is typically its longest dimension and extends across the mask body to traverse the wearer's nose when the respirator is worn) that is widest at the bridge and tapers toward the ends (see, for example, FIG. 2). In another embodiment, the width can be substantially constant with optionally rounded corners. In some preferred embodiments, the nose clip has a width over at least about 70% of its length of about 0.5 to 2 centimeters (cm). In some embodiments, the material forming the nose clip preferably has a thickness of about 3 millimeters (mm) or less, more preferably about 2 mm or less, and still more preferably less than about 1 mm. At the lower end, the nose clip typically is greater than about 0.2 mm in thickness. In some embodiments, the nose clip has a relatively narrow curvature with a circumference (measured along the surface facing the mask body) changing direction by at least about 130° (preferably about 150°) over a path distance of 3 cm or less (more preferably 2 cm or less) where the midpoint of the path distance being a line 44 that bisects the nose clip as shown in FIG. 3. The term "curvature" should not be understood as necessarily implying a semi-circular shape, or even a smooth curve, because the nose clip could have other shapes—for example, a series of three 60° angles. The first and second wing portions 28 and 30 (FIGS. 2 and 3) help form a good seal, and each wing portion preferably has a length of about 0.5 to 3 cm, in some embodiments 1 to 2 cm.

The nose clip can be molded to a desired shape and then applied to the mask body. Alternatively, a polymeric material can be applied onto a mask body and formed to a desired shape while on the mask body. The nose clip can be molded into a desired shape by heating and pressing a thermoplastic polymer sheeting in a mold (for example, see the anvil of FIG. 9). Molding could be performed on a sheet alone or on a sheet with other components and could include molding a thermoplastic or a thermosetting resin along with the mask body. Also, the mask body could be shaped and then a polymeric material applied to the shaped mask body. In this embodiment, the polymer material could be unshaped until it is applied to the mask body (as a perform or by spraying, for example). The nose clip may be attached to the mask body by gluing or welding, for example ultrasonic welding or heating. Since one or both of the nose clip and mask body comprise polymers, melted or softened material can form a good bond. The nose clip can be bonded to the mask body at the ends, at the midsection, at various selected locations, or along its entire length. In addition to solid preforms, the nose-clip material could be applied in liquid form and subsequently hardened.

Figure 7:
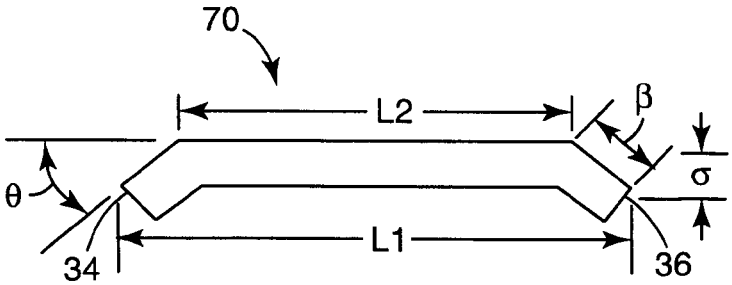
FIG. 7 is a plan view of a preform 70 that is suitable for use in making a nose clip 54 (FIG. 5) in accordance with the present invention.

Preforms that are subsequently shaped to form a nose clip can be a straight, thin sheet. In other embodiments, preforms can be curved or angled, flat thin strips. As shown in FIG. 7, for example, the preform 70 can have a straight center portion L2 and angled end portions β. In this embodiment, the center portion L2 is preferably 4 to 8 cm long, and the angled end portions β are preferably 0.5 to 2 cm long as measured along the outer edge. In an embodiment shown in FIG. 8, the preform 72 can have parallel, center, and end portions separated by angled intermediate portions. In this embodiment, the center portion L4 is preferably 3 to 7 cm long, the angled intermediate portions are preferably 0.5 to 2 cm long as measured along the outer edge Δ, and the end portions 34, 36 are preferably 0.4 to 2 cm long as measured along the outer edge (Σ in FIG. 8).

The following Examples have been selected merely to further illustrate features, advantages, and other details of the invention. While the Examples serve this purpose, the particular ingredients and amounts used as well as other conditions and details are not to be construed in a manner that would unduly limit the scope of this invention.

EXAMPLES

General Nose Clip Making

Figure 8:
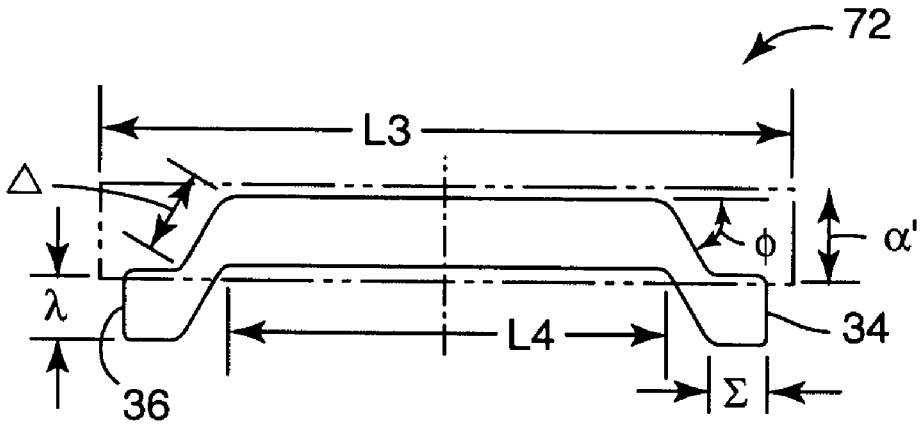
FIG. 8 is a plan view of another preform 72 that is suitable for making a nose clip 49 (FIG. 4) in accordance with the present invention.

Nose clips of the invention were made by cutting a preform from a sheet of material into a desired configuration. Examples of the invention used a 0.76 mm thick polyethylene terephthalate (PET) film, type P-1202, available from the Petco Division of the Layergne Group, Montreal, Canada. The preform was cut from the film using a die-stamp having an outline of the desired configuration. Two preform configurations were used, Preform A or Preform B as shown in FIGS. 7 and 8, respectively. Preform A had dimensional values for L1, L2, β, σ, and θ equal to 81.4 mm, 63 mm, 13 mm, 9 mm, and 45° respectively; Preform B had dimensional values for L3, L4, Δ, Σ, Φ, and λ equal to 89 mm, 56 mm, 11 mm, 7 mm, 9 mm, and 60°, respectively. Respirator masks used in the Examples were commercially available respirators, of a specified type, manufactured by 3M Company, St. Paul, Minn. The only modification to the respirators was that they had their original nose clips removed.

Preforms were positioned on the masks in place of their originally supplied nose clips and affixed at specified points using adhesive or thermal bonding methods such as ultrasonic welding. When ultrasonic welding was used, a E-150 type ultrasonic welding unit, from Branson, Danbury, Conn. was employed. The welder was fitted with a flat-surface horn that directed energy to a pinned anvil that was placed inside the mask, under the intended point of attachment. The hand-held welder was operated at a power, approximate pressure, and dwell time of 80%, 20 N force, and 1 second, respectively. The resulting weld area was approximately 8 mm×8 mm on the centerline (e.g., longitudinally in FIG. 8) at the edges of the preform. As indicated in the individual Examples, the preform was shaped either on the mask, or shaped separately and then attached to the mask in an additional step.

Figure 9:
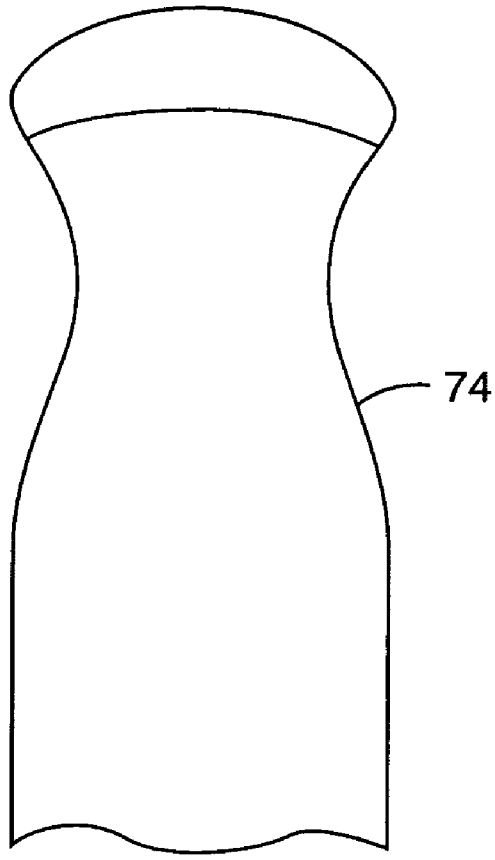
FIG. 9 is a front view of a tool 74 that is suitable for use in deforming a preform into a nose clip of the present invention.
Figure 10:
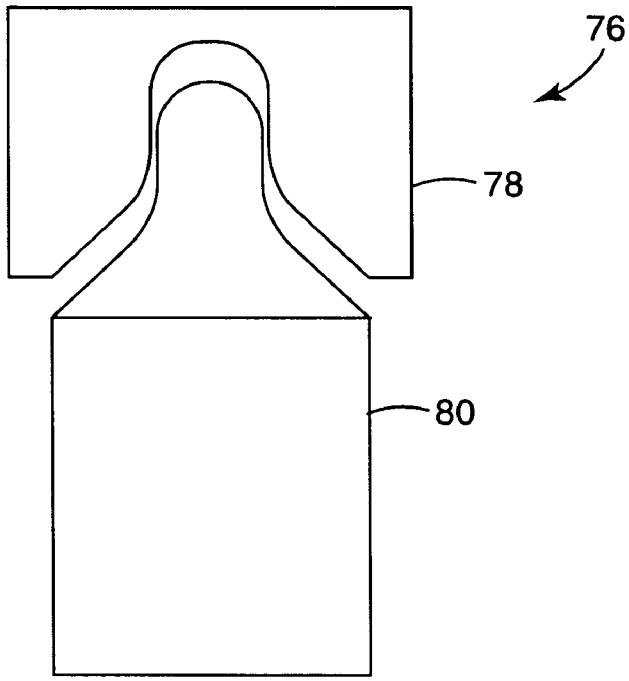
FIG. 10 is a front view of a tool 76 that is suitable for use in deforming a preform into a nose clip of the present invention.

Shaping of the preform was done using a molded tool, with male and female clamping parts, to impart the desired finished nose clip curvature. One of two molding tools were used in shaping of the preform, Tool A 74 or Tool B 76 (having male and female parts 78 and 80 respectively), as shown in FIGS. 9 and 10 respectively. Shaping of the preform could be done before fixing the preform to a respirator mask, or, alternatively, after the preform was affixed to the mask. Shaping was done under heat and pressure for a specified dwell time. The resulting nose clip was allowed to cool while held in the desired shape to establish its contour. Following this prescribed procedure, nose clips of the invention were produced, with greater detail and specificity given below in individual Examples.

Test Procedures

Mechanical Testing Procedure

Figure 11:
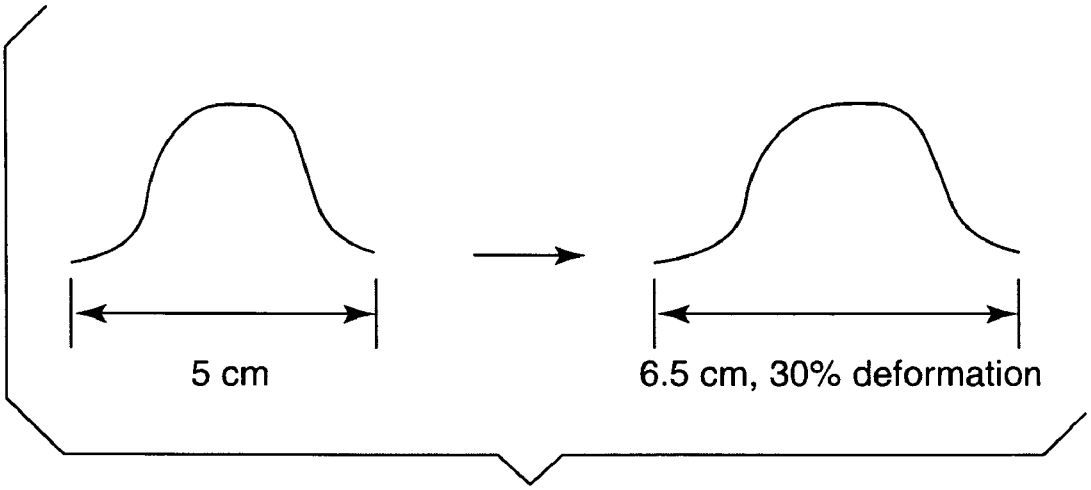
FIG. 11 illustrates an example of the deflection of a nose clip when carried out according to the Mechanical Testing Procedure set forth below.

Mechanical testing of examples of the invention were conducted using a tensile testing machine available from Instron, Canton, Mass., model 554302, type 4302, equipped with a 100 N load cell. To minimize undesired flexure of the nose clip during testing, two flexible cords were attached to the nose clip at points that approximated attachment points to a respirator mask. The flexible cords that were used were a 150 mm long by 2 mm wide section of Scotch Brand Filament Tape, type 893, manufactured by 3M Co., St. Paul, Minn. Each cord was attached to an end of the nose clip at a location half-way across the width approximately 4 millimeters (mm) away from each end. The cords that were attached to the nose clip were placed in the jaws of a testing device such that equal, 30 mm lengths of cord extending between the nose clip and each jaw. The sample was then drawn at crosshead speed of 50 mm/min until a desired extension was reached. Care was taken not to preload the nose clip. Loads at a 30% extension of the original length of the unloaded nose clip were recorded. FIG. 11 illustrates an example of a nose clip that was extended in length during mechanical testing.

Fit Test

The fit test evaluates leakage of aerosol through the face seal. Fit tests were conducted as described by the procedures outlined in the United States Code of Federal Regulations, Title 29, Appendix A to § 1910.134: Fit Testing Procedures (Mandatory), Part I, C, 2. Test results are reported as a fit factor. The fit factor is a ratio of the test aerosol concentration outside of the mask to its inside concentration. A higher fit factor number indicates a better fit.

Total Inward Leakage

The total inward leakage test measures the total percent of aerosol penetration through the filter mask and face seal. Total inward leakage (TIL) testing of examples of the invention, with the nose clip installed on a respirator and fitted to an individual, were conducted using the procedures outlined by the Japanese Ministry of Health, Labor, and Welfare Ordinance, Notification No. 19 of Mar. 30, 1988, Article 7, Paragraph 3.2. Test results are reported as a percent of NaCl particle challenge. Lower TIL numbers for a given respirator design indicate better performance, that is, less leakage.

Example 1

A nose clip of the invention was formed as outlined in the Nose Clip Making Procedure section set forth above. A preform having the configuration of FIG. 7 was cut from a polyethylene terephthalate (PET) film. The preform was attached to a 3M 8210™ respirator mask body (without the standard metal nose clip) using pressure sensitive tape, Scotch 300LSE High Strength, available from the 3M Company, St. Paul, Minn. The tape was applied to the entire underside of the preform to secure it to the mask. After the preform was attached to the mask, it was molded to its predefined shape while mounted to the mask body. The shaping tool shown in FIG. 9 was used to shape the preform into a nose clip. The preform was molded at a temperature of approximately 88° C. while applying a clamp force of approximately 10 Newtons for about 5 to 6 seconds. While formed on the tool, the nose clip was cooled to a temperature of approximately 60° C. for 5 to 6 minutes. Twenty masks were created in this manner. Ten of these masks were fit tested. The average fit factor was 154.

Example 2

A nose clip of the invention was formed as outlined in the Nose Clip Making Procedure section set forth above. A preform that had the shape of FIG. 7, was cut from a PET film. The preform was attached to a 3M 8511™ respiratory mask body using ultrasonic welding. The preform was welded to the mask at points extending from the ends 34 and 36, inward along the β dimension, as shown in FIG. 7. After the preform was attached to the mask, it was molded to its predefined shape using the molding tool 74 shown in FIG. 9. Molding was carried out at a temperature of approximately 88° C. using a clamp force of about 10 Newtons for 5 to 6 seconds. While in the tool, the nose clip was cooled to a temperature of approximately 60° C. for 5 to 6 minutes. TIL was evaluated on three masks made in this fashion. The resulting TIL was 1.6%, 0.2%, and 6.6% on three masks fitted to three individuals.

Example 3

A nose clip of the invention was formed as outlined in the Nose Clip Making Procedure section set forth above. A perform having the configuration shown in FIG. 10 was cut from PET film. The preform was attached to a 3M 8511™ respiratory mask body (without the standard metal nose clip) using ultrasonic welding. The preform was welded to the mask at points extending from the ends 34 and 36, inward along the Σ dimension, as shown in FIG. 8. After the preform was attached to the mask, it was molded on the mask using the molding tool 76 of FIG. 10 at a temperature of approximately 93° C., a clamp force of about 10 Newtons, and a dwell time of 3 to 4 seconds. While in the tool, the nose clip was cooled to a temperature of approximately 60° C. for 5 to 6 minutes. The mask of this example had good face fitting characteristics.

Example 4

A nose clip of the invention was formed as outlined in the Nose Clip Making Procedure section set forth above, except that no mask was used. A preform, having the configuration of FIG. 8, was cut from a PET film. The preform was molded using the tool of FIG. 10. Molding was carried out at a temperature of approximately 93° C., a clamp force of about 1 Newton, and a dwell time of about 3 to 4 seconds. The shaped preform was then transferred to a second unheated tool, having the configuration of FIG. 10. A clamp force of 1 Newton was applied, and the clip was allowed to cool to a temperature of approximately 60° C. for 1 to 2 minutes. The nose clip was tested according to the Mechanical Testing Procedure. The nose clip demonstrated a 0.53 N force at a 30% extension. Two other nose clips were similarly tested, the following table summarizes the results:

| Nose Clip Material | Load at 30% Strain (Newtons) force in Newtons |
|---|---|
| PET 17 mil | 0.11 |
| PET 30 mil | 0.53 |
| Polycarbonate, 30 mil | 0.52 |

Example 5

A nose clip of the invention was formed as outlined in the Nose Clip Making Procedure section set forth above. A preform, having the configuration of FIG. 8, was cut from a PET film. Preform molding was done using molding at a temperature of approximately 93° C. A clamp force of about 10 Newtons was applied for about 3 to 4 seconds. After the preform was shaped, it was transferred to a second, unheated tool, having the configuration of FIG. 10, clamped at a force of about 10 N, and allowed to cool to a temperature of approximately 60° C. for about 1 to 2 minutes. The resulting nose clip was attached to a 3M 8511™ respirator mask body using ultrasonic welding. The nose clip was welded to the mask at the ends 34 and 36, inward along the Σ dimension (FIG. 8). A weldable headband was attached as described in U.S. Pat. No. 6,332,465B1 to Xue et al. The mask had good face fitting characteristics.

Example 6

A tool that had the shape shown in FIG. 10 was used to cast a plastic nose clip. Epoxy resin (3M Scotch Weld 1838-L, A and B) was poured into the mold to cast the shaped nose clip. The epoxy starting material components were measured at about 2 g each and were mixed thoroughly in a plastic sample weigher. The tool parts were wrapped with plastic film to provide easy release after curing. The gap between the molds was set at 1.6 mm, and the molds were pre-warmed to 60° C. before the epoxy mixture was poured in. After pouring the mixture, the molds were kept at room temperature overnight (more than 12 hours) for a total cure. After curing, the molds and plastic liner were removed. A nose clip having approximately the shape shown in FIG. 4 with a width of 12 mm (but not having feet 46 and 48) was obtained. A 3M Scotch Brand double-sided tape was used to attach the nose clip onto a 3M 8511™ respirator mask body that had the original aluminum nose clip removed. A respirator with nonmetal prestressed nose clip was then obtained.

This invention may take on various modifications and alterations without departing from its spirit and scope. Accordingly, this invention is not limited to the above-described but is controlled by the limitations set forth in the following claims and any equivalents thereof.

This invention may be suitably practiced in the absence of any element not specifically disclosed herein.

All patents and patent applications cited above, including those in the Background section, are incorporated by reference into this document in total.

What is claimed is:

1. A respirator that comprises:

(a) a mask body that comprises a layer of filter media; and (b) a nose clip that is disposed on the mask body and that is adapted to extend over a bridge of a wearer's nose when the mask is worn, the nose clip having a resilient predefined shape that comprises first and second wing portions and that also is adapted to exert a force on each side of the wearer's nose when the respirator is worn such that the force is exerted inward towards the wearer's nose at least at the first and second wing portions without manual adaptation of the predefined nose clip shape.

2. The respirator of claim 1, wherein the nose clip is also adapted to exert a force at a cheek of a wearer's face below the wearer's eye when the respirator is worn.

3. The respirator of claim 2, wherein the nose clip has a thickness of 2 mm or less.

4. The respirator of claim 3, having a midsection that is located centrally with respect to the first and second wing portions, and wherein the first and second wing portions extend from the midsection and each have a length of about 0.5 to 3 cm.

5. The respirator of claim 4, wherein the nose clip changes direction by at least 130° over a path distance of 3 cm or less where the midpoint of the path length is a line that bisects the nose clip.

6. The respirator of claim 1, further comprising a harness.

7. The respirator of claim 1, wherein the nose clip has a midsection that includes a predefined radius about 0.3 to 1.2 centimeters.

8. The respirator of claim 1, wherein the nose clip has a midsection that includes predefined radius of about 0.5 to 0.9 centimeters.

9. The respirator of claim 1, wherein the nose clip comprises an integrally molded polymeric material that has an elastic modulus of about 1 to 15 GPa.

10. The respirator of claim 1, wherein a load of 1 N or less applied to the nose clip, as described in the Mechanical Testing Procedure, results in a 30% strain.

11. The respirator of claim 1, wherein the nose clip, when viewed from the side, has a convex midsection located centrally between first and second concave sections, the midsection also contributing to exerting the inward force.

12. The respirator of claim 11, wherein the nose clip length can be extended by at least 30% when exposed to a force under the Mechanical Testing Procedure and can return to its original shape immediately after the force is removed.

13. The respirator of claim 11, wherein the nose clip when viewed from the side generally takes a 180° symmetrical turn in the concave midsection about a line that bisects the nose clip.

14. The respirator of claim 1, wherein the first and second wing portions are able to resiliently deflect from their predefined position by 15° or more.

15. A method of making a respirator, which method comprises:

(a) providing a mask body and a polymeric nose clip;

(b) placing the polymeric nose clip on the mask body such that the nose clip extends over a bridge of the wearer's nose when the mask is worn; and (c) providing the nose clip with a predefined shape that has a semi-rigid, resilient character wherein the predefined shape allows the nose clip to exert a force on each side of the wearer's nose without manual adaptation of the nose clip shape.

16. The method of claim 15, wherein step (b) occurs before step (c).

17. The method of claim 16, wherein the nose clip is placed on the mask body by at least an ultrasonically welding step.

18. The method of claim 15, wherein step (c) occurs before step (b).

19. The method of claim 18, wherein the nose clip comprises a thermoplastic polymer, and further comprises a step of molding the thermoplastic polymer into a predefined shape at a temperature in the range of about 90° C. to about 250° C., before being placed on the mask body.

20. The method of claim 15, wherein the nose clip consists essentially of a polymer.

* * * * *